US006843301B2

(12) United States Patent
Carrillo et al.

(10) Patent No.: US 6,843,301 B2
(45) Date of Patent: Jan. 18, 2005

(54) AWNING ROLLER WITH INTERNAL MOTOR

(75) Inventors: Alejandro Carrillo, Dearborn, MI (US); Brent Wagner, Streamwood, IL (US); Thomas Lozito, El Paso, TX (US)

(73) Assignee: Dometic Corporation, Elkhart, IN (US)

( * ) Notice: Subject to any disclaimer, the term of this patent is extended or adjusted under 35 U.S.C. 154(b) by 0 days.

(21) Appl. No.: 10/237,912

(22) Filed: Sep. 9, 2002

(65) Prior Publication Data

US 2004/0045683 A1 Mar. 11, 2004

(Under 37 CFR 1.47)

(51) Int. Cl.[7] ..... E06B 9/56
(52) U.S. Cl. ..... 160/310; 160/67
(58) Field of Search ..... 160/67, 66, 310, 160/311, 312, 188, 405; 135/88.11, 88.12

(56) References Cited

U.S. PATENT DOCUMENTS

| | | | | |
|---|---|---|---|---|
| 3,847,171 | A | | 11/1974 | Akers et al. |
| 4,042,028 | A | | 8/1977 | Ennes et al. |
| 4,172,563 | A | | 10/1979 | Werner et al. |
| 4,372,367 | A | | 2/1983 | Baldanello et al. |
| 4,411,348 | A | | 10/1983 | Fillion |
| 4,417,185 | A | | 11/1983 | Bullat |
| 4,615,371 | A | | 10/1986 | Clauss |
| 4,651,940 | A | | 3/1987 | Nakamura |
| 4,665,965 | A | | 5/1987 | Pasquier et al. |
| 4,766,941 | A | | 8/1988 | Sloop et al. |
| 4,974,658 | A | | 12/1990 | Komatsu et al. |
| 5,123,474 | A | | 6/1992 | Smith |
| 5,198,974 | A | | 3/1993 | Orsat |
| 5,586,592 | A | | 12/1996 | McGregor |
| 5,699,847 | A | | 12/1997 | Villette et al. |
| 5,709,349 | A | | 1/1998 | De Chevron Villette et al. |
| 5,711,360 | A | | 1/1998 | Viotte |
| 5,803,150 | A | | 9/1998 | Boiteau |
| 5,847,525 | A | | 12/1998 | Chéron et al. |
| 5,896,908 | A | | 4/1999 | Kaun |
| 5,975,185 | A | | 11/1999 | Miller et al. |
| 6,111,376 | A | | 8/2000 | Jean-Marc |
| 6,142,209 | A | * | 11/2000 | Girard ..... 160/22 |

* cited by examiner

*Primary Examiner*—David Purol
(74) *Attorney, Agent, or Firm*—Pearne & Gordon LLP

(57) ABSTRACT

An awning drive assembly with a motor internal to an awning roll-up tube and/or the awning using the awning drive assembly. A transmission linkage is attached to a motor assembly which is at least partially inserted into the roll-up tube of the awning. The transmission linkage is a disk connected to a motor shaft and the disk has notches which engage corresponding projections within the roll-up tube, allowing the motor to deploy and retract the awning. The awning drive assembly also has a mechanism for releasably connecting the motor assembly to a support arm mounting assembly. When the means for releasably connecting is released, a spring retracts the awning, even when the motor is not operable.

32 Claims, 3 Drawing Sheets

AWNING ROLLER WITH INTERNAL MOTOR

BACKGROUND OF THE INVENTION

This invention relates generally to roll-up awnings, and in particular to awnings used for buildings, travel trailers, or recreational vehicles, and specifically to an awning roller assembly with a motor embedded within a roll-up tube for deploying and retracting the awning.

It has long been recognized that roll-up awnings are useful in the recreational vehicle field. Such awnings are particularly useful when trailer homes or recreational vehicles are parked at a campsite. While parked, there is a need for a protected area in which users may take cover from inclement weather. A spring-biased, roll-up awning has long been used in the field.

A roll-up, retractable awning generally comprises a canopy connected at one edge to the wall of a building or recreational vehicle, and at the opposite edge connected to a roller tube. The roller tube is pivotally supported by extended arms which are pivotally mounted to the wall. In a stored position, the canopy is rolled about the roller tube and secured to the wall. When the awning is in use, the canopy is unrolled and is supported by the roller tube which is in turn supported by the extended side arms.

In the unrolled position, the roller tube must not only support the weight of the canopy, but also the weight of other attachments (such as a screen or a valance and any motors), as well as resist the forces of nature (such as wind and rain).

Retractable awnings may have a stationary roller tube mounted to the wall, or a roller tube that is extended outward by support arms. When not deployed, the awning canopy is typically rolled around the tube for storage and, if used on a vehicle, for travel.

Retractable awnings can be manually operated, or they may utilize a motor to make extension and retraction automated and quicker. Typically, the motor is positioned on one of the arms, outside the roll tube. This may expose the motor to the elements, and could lead to an awning that is either not as wide as it could be due to the width of the motor, or results in a motor that sticks out from the arm, making the motor subject to potential damage. Further, the exterior motor can be aesthetically displeasing to the user.

In contrast, a motor contained with the roller itself is better protected from the elements and also better protected against physical damage. Further, hiding the motor in the tube improves the aesthetic appearance of the awning, may provide sound deadening, and also helps maximize the potential width of the awning itself. Further, placing the motor inside the roller tube can provide advantages in the assembly of the awning, can reduce total part counts, and can provide other advantages as well. It would also be beneficial if such an in-the-tube motor solution could be easily retrofitted to awnings already on the market or in use.

SUMMARY OF THE INVENTION

Provided is an awning drive assembly for use in an awning having a roll-up tube. The awning drive assembly has a motor assembly, with motor assembly including a motor with a motor shaft extending from an end of the motor; and a transmission linkage connected to the motor shaft.

The transmission linkage is rotationally connected to the tube when the transmission linkage is inserted into the tube.

The transmission linkage rotates when the motor shaft is rotated when the motor is operated, thereby causing the tube to rotate for deploying or retracting the awning.

Also provided is an awning drive assembly for use in an awning having a roll-up tube, with the awning drive assembly comprising a motor assembly for at least partially inserting into the tube.

The motor assembly includes a motor having a motor shaft extending from an end of the motor; and a transmission linkage connected to the motor shaft, with the transmission linkage connected to the tube when the transmission linkage is at least partially inserted into the tube. The transmission linkage rotates when the shaft is rotated when the motor is operated, thereby causing the tube to rotate for deploying or retracting the awning.

Further provided is an awning roller assembly for use in an awning. The awning roller assembly uses one of the awning drive assemblies as described above, wherein the roll-up tube, which is part of the awning roller assembly, has one or more projections, and further wherein the transmission linkage forms one or more notches, each projection being received by a corresponding notch of the transmission linkage when the transmission linkage is inserted into the tube.

Still further provided is an awning comprising a roll-up tube having one or more projections inside the tube and also comprising a canopy having one end connected to the roll-up tube, with the canopy being rolled-up on the roll-up tube when the awning is retracted, and with the canopy also being un-rolled from the roll-up tube when the awning is deployed.

The awning also comprising a motor assembly at least partially inserted into the tube. The motor assembly includes a motor having a motor shaft extending from a first end of the motor, with the motor shaft rotating when the motor is operated for deploying or retracting the canopy; and the motor assembly also includes a transmission linkage fixably connected to the motor shaft, the transmission linkage forming one or more notches, each for receiving a different one of the projections when the motor assembly is at least partially inserted into the tube. The transmission linkage rotates when the motor shaft is rotating, thereby causing the tube to rotate.

The awning also comprising a support arm mounting assembly for mounting on a support arm. The support arm mounting assembly is releasably connected to the motor assembly, with the mounting assembly movably connected to an end of the tube. If the motor is operated to rotate in one direction, the awning is deployed, and further, if the motor is operated to rotate in an opposite direction, the awning is retracted.

Even further provided is an awning comprising a roll-up tube having a plurality of projections inside the tube projecting from the interior of the tube, and a canopy having one edge connected to the roll-up tube with the canopy being rolled-up on the roll-up tube when the awning is retracted, and the canopy also being un-rolled from the roll-up tube when the awning is deployed.

The awning also comprising a motor assembly at least partially inserted into the tube. The motor assembly includes a motor having a motor shaft extending from a first end of the motor, with the motor shaft rotating when the motor is operated for deploying or retracting the canopy.

The motor assembly also includes a transmission linkage fixably connected to the motor shaft, with the transmission linkage forming a plurality of notches corresponding to the plurality of projections of the tube. Each of the plurality of notches is for receiving one of the plurality of projections when the motor assembly is at least partially inserted into the tube. The transmission linkage rotates when the motor shaft is rotating, thereby causing the plurality of notches to engage the plurality of projections thereby causing the tube to rotate.

The motor assembly still further includes a motor sleeve for mostly covering the motor when the motor is inserted into the motor sleeve, and a sleeve cap fixably connected to the motor sleeve, with the sleeve cap for holding the motor within the motor sleeve. The sleeve cap has a sleeve cap projection projecting from one end.

The awning further comprising a spring for biasing the roll-up tube for aiding the retraction of the awning to a stowed position; and a support arm mounting assembly for mounting on a support arm.

The support arm mounting assembly includes an end support cap movably connected to the sleeve cap projection, wherein the roll-up tube is fixably connected to the end support cap, allowing the roll-up tube to rotate along with the end support cap. The support arm mounting assembly further includes a support arm mounting structure fixably connected to an end of the support arm; and means for releasably connecting the sleeve cap projection to the support arm mounting structure, wherein the motor within the motor assembly is prevented from rotating within the tube by the means for releasably connecting when the motor shaft is rotating the roll-up tube.

If the motor is operated to rotate in one direction, the awning is deployed, but if the motor is operated to rotate in the opposite direction, the awning is retracted.

Further, if the awning is at least partially deployed, when the means for releasably connecting is released, the motor can freely rotate with the roll-up tube, whereby the spring biases the awning to retract into at least a mostly stowed position.

Additionally provided is an awning roller assembly for use in an awning, the awning roller assembly comprising a roll-up tube having at least three projections inside the tube. The projections project from the interior of the tube toward a center axis of the tube, and the projections are evenly distributed across an interior circumference of the tube, with the projections extending along substantially the entire longitudinal length of the tube.

The awning roller assembly also comprising a motor assembly at least partially inserted into the tube. The motor assembly includes a motor having a motor shaft extending from a first end of the motor, with the motor shaft rotating when the motor is operated for deploying or retracting the canopy.

The motor assembly also includes a transmission linkage fixably connected to the motor shaft, with the transmission linkage forming at least three notches corresponding to the at least three projections of the tube, with each of the at least three notches for receiving one of the at least three projections of the tube when the motor assembly is at least partially inserted into the tube. The transmission linkage rotates when the motor shaft is rotating, causing the at least three notches to engage the at least three projections, thereby causing the tube to rotate.

The awning roller assembly still further comprising a support arm mounting assembly for mounting on a support arm, the support arm mounting assembly connected to an end of the motor assembly; the mounting assembly movably connected to an end of the tube.

Further provided is an awning drive assembly for use in an awning including a roll-up tube having one or more slots extending to at least one end of the tube.

The awning drive assembly comprising a motor assembly for at least partially inserting into the tube, with the motor assembly including a motor having a motor shaft extending from an end of the motor; and a transmission linkage connected to the motor shaft, the transmission linkage having at least as many fingers as there are slots, with each slot receiving a corresponding one of said fingers when the transmission linkage is inserted into the tube. The transmission linkage is rotated when the shaft is rotated when the motor is operated, thereby causing the tube to rotate for deploying or retracting the awning.

Still further provided is a method of installing an awning drive assembly for use in an awning including a roll-up tube having one more or more projections. The method comprising the steps of obtaining the awning; and inserting a motor assembly at least partially into an end of the tube.

The motor assembly includes a motor having a motor shaft extending from an end of the motor; and a transmission linkage connected to the motor shaft. The transmission linkage forms one or more notches, wherein each of the projections is received by one of the notches when the transmission linkage is inserted into the tube. The transmission linkage rotates when the shaft is rotated when the motor is operated, thereby causing the tube to rotate for deploying or retracting the awning.

And still further provided is the above method including the additional steps of:

connecting a support arm mounting assembly to a support arm of the awning, with the support arm mounting assembly fixably connected to an end of the motor assembly and the support arm mounting assembly having an end cap moveably connected to the support arm mounting assembly; and fixably connecting the end cap to the end of the roll-up tube.

DETAILED DESCRIPTION OF THE PREFERRED EMBODIMENTS

Figure 1:
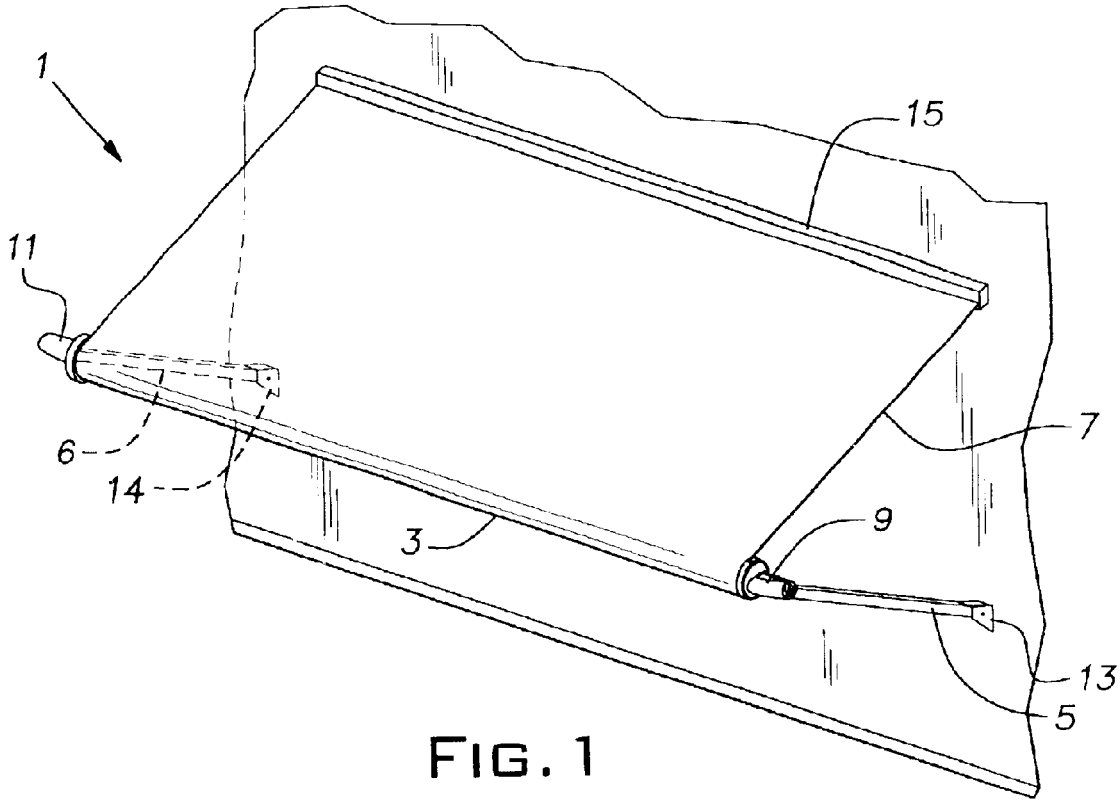
FIG. 1 is a diagram showing the awning connected to a wall in a partially deployed condition.

FIG. 1 shows one possible embodiment of the awning at least partially deployed. The awning has a canopy 7, rolled on and connected to a roll-up tube 3. The canopy is preferably waterproof, and typically will be at least partially opaque to provide sun protection. The awning has a roll-up tube 3 with a motor assembly at least partially inserted inside (not shown in FIG. 1), with the roll-up tube 3 connected to a support arm mounting assembly 9 at one end, and a support end 11 at another end.

The support arm mounting assembly 9 is typically connected to a support arm 5, for example, while the support end 11 is typically connected to a support arm 6, for example. The support arms are typically connected to the wall of a house or vehicle via wall mounts 13, 14. The canopy is also typically connected to the wall via a canopy mount 15. Alternative methods of mounting the awning are also well known in the art, and are easily accommodated by the invention.

Figure 2:
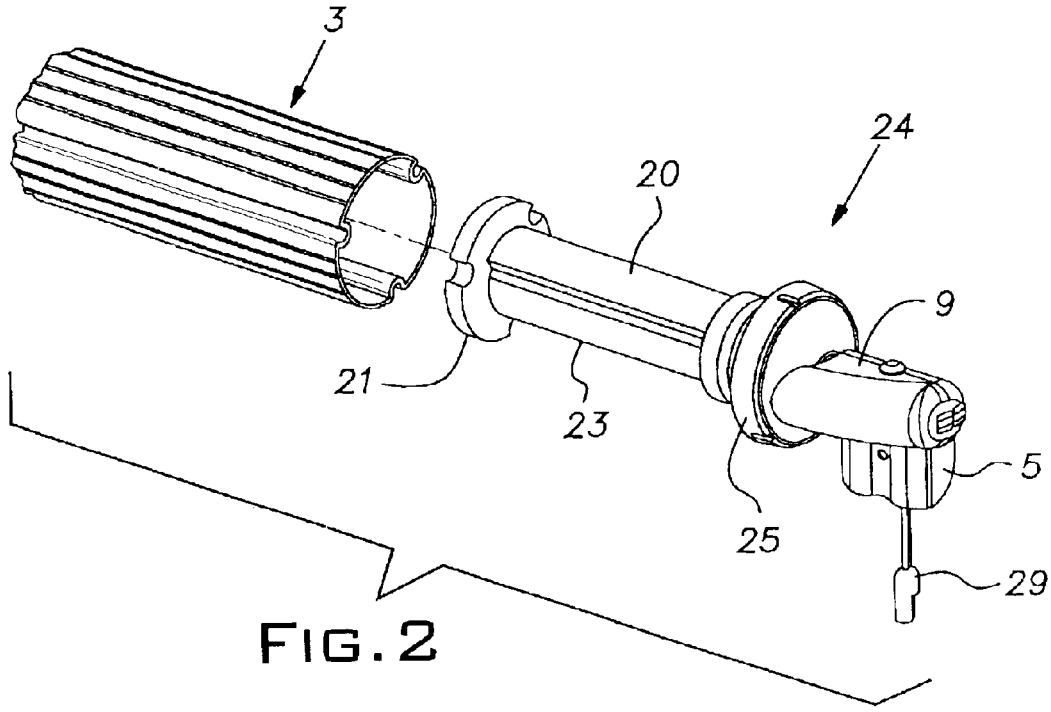
FIG. 2 shows a side portion of the awning including an awning drive assembly 24 with an example roll-up tube 3 in greater detail for one embodiment of the awning.

FIG. 2 shows the motor assembly 20 and the support arm mounting assembly 9 as one fully assembled awning drive assembly 24, showing the drive assembly 24 in detail as it would appear before it is inserted into the roll-up tube 3. As shown in FIG. 2, the motor assembly 20 has a transmission linkage 21, such as the slotted disc device shown, for example, at one end of the assembly. A motor sleeve 23 is shown, which covers and protects the motor (not shown in FIG. 2). The support arm mounting assembly has an end support cap 25, as shown. During assembly, the motor assembly 20 portion of the awning drive assembly 24 is at least partially, and can be mostly or fully, inserted into the roll-up tube 3 up to the end support cap 25 of the support arm mounting assembly 9. The motor assembly 20 is inserted into the roll-up tube 3 at the time of assembly with the end support cap 25 connecting to an end of the roll-up tube 3, providing physical support to the roll-up tube 3. The end support cap 25 rotates along with the roll-up tube 3 when the awning is deployed or retracted.

The end support cap 25 is part of the support arm mounting assembly 9, which is mounted on the support arm 5. The motor power cable 29 (shown in FIG. 3) is run through the support arm mounting assembly 27 and through the support arm 5 to a deployment/retraction control and power device (not shown).

Figure 3:
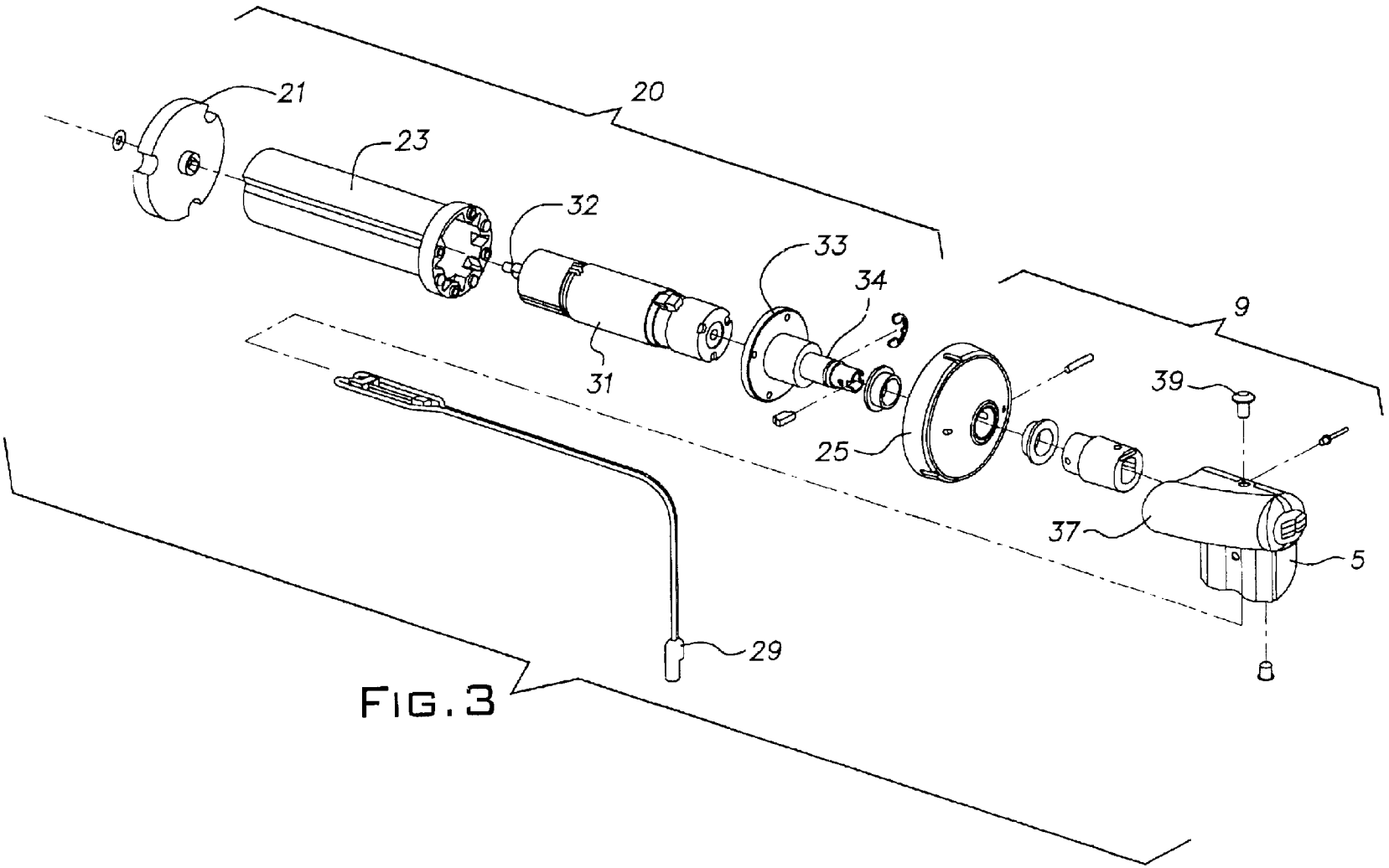
FIG. 3 shows an exploded side view of the awning drive assembly 24, further decomposing the motor assembly 20 and the support arm mounting assembly 9 into subcomponents.

FIG. 3 shows an exploded view of the awning drive assembly 24, further decomposing the motor assembly 20 and the support arm mounting assembly 9 into sub-components.

The motor assembly 20 comprises the transmission linkage 21, as shown, along with the motor sleeve 23, and a motor 31, which is inserted into the motor sleeve 23 during assembly. The motor 31 has a motor shaft 32, which extends through an end of the motor sleeve 23, and upon which the transmission linkage 21 is mounted and connected. When the motor 31 is powered, the motor shaft 32 rotates, which causes the transmission linkage 21 to rotate, thus transferring the rotational motion to the roll-up tube 3. The motor 31 is sealed into the motor sleeve 23 by the sleeve cap 33, which is mechanically fastened to the motor sleeve 23 using a fastening device such as screws, rivets, or some other means of fastening. An end of the sleeve cap 33 holds the motor within the motor sleeve 31. The sleeve cap 33 has a sleeve cap projection 34 extending from the end opposite the end connected to the motor sleeve 23. The motor power cable 29 is also shown. The motor power cable 29 is connected to the motor 31 in a releasable manner, such that the motor is permitted to rotate within the roll-up tube in special circumstances without being hindered by the motor power cable 29. The motor power cable 29 has a power cable routed through the support arm mounting assembly and either through, or on a surface of, the support arm 5. The power cable may be covered with a protective sleeve or covering to protect it from abrasion, damage, and the weather.

Further shown in FIG. 3 is the support arm mounting assembly 9 comprising an end support cap 25 moveably mounted on a support arm mounting structure 37, which is fixably mounted on the support arm 5. The end support cap 25 is connected to the support arm mounting structure 37 using appropriate grommets, sleeves, bushings, bearings and/or any other necessary components to allow the end support cap 25 to freely rotate with respect to the support arm mounting structure 37. This allows the roll-up tube 3 to freely rotate along with the end support cap 25, with respect to the support arm mounting structure 37 when the roll-up tube 3 is inserted into, and connected to, the end support cap 25 during assembly and operation.

The support arm mounting assembly can be designed using various options and/or alternatives in order to accommodate alternative roll-up tube and support arm designs, especially in cases where the awning drive assembly is retrofitted to an existing awning. This is especially true with respect to the arm mounting features and the roll-up tube mounting features, which may need to be modified in order to be properly installed onto existing or future awning devices.

During assembly, the sleeve cap projection 34 is inserted into and through the end support cap 25, into the support arm mounting structure 37. Again, appropriate grommets, sleeves, bushings, bearings and/or any other necessary components to allow the end support cap 25 to freely rotate with respect to the end support cap 25 are utilized in this assembly. Means for releasably connecting (39 is an example) is used to fixably connect the motor assembly to the support arm mounting assembly by connecting the sleeve cap projection of said sleeve cap to said support arm mounting structure. This means for releasably connecting 39, 39' is a motor assembly release structure. As shown, it can be implemented by using a securing component 39, such as a screw, a bolt, key, or a pin device, for example, in combination with a securing sleeve 39' implemented by using grommets, washers, or sleeves, for example, any of which might be keyed or drilled to mate with the securing component 39. As shown, the securing sleeve 39' is fixably connected to the sleeve cap projection 34, while the securing component 39 releasably connects the securing sleeve 39' to the support arm mounting structure 37 (for example, by using a bolt, screw, or pin through the support arm mounting structure 37 into the securing sleeve 39'). When fully assembled, the means for releasably connecting 39, 39' prevents the motor sleeve, and thereby the motor, from rotating when the motor rotates the roll-up tube 3, along with the end support cap 25, during deployment or retraction. When releasing the securing component 39, such as by unscrewing a screw or pulling a pin or releasing a key, for example, the securing sleeve is released, allowing the motor to freely rotate (with the motor being released form the motor power cable 29). Accordingly, a biasing spring of the awning (not shown) can then bias the roll-up tube to retract the awning. By including such a biasing spring, thus provided is a means for retracting the awning should the motor not be operable, such as during a power failure or if the motor or its control circuitry should fail. This feature is especially useful if the awning is mounted on a vehicle, so that the awning can be manually stowed in case of a motor or electrical failure, for example, and thus the vehicle be able to safely operate.

Figure 4:
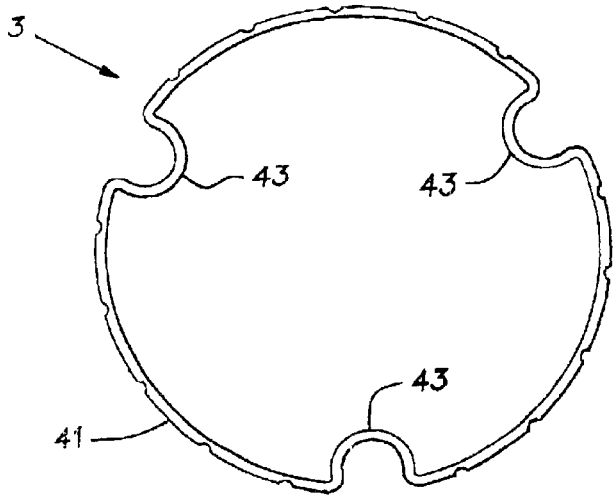
FIG. 4 shows an end view of the roll-up tube 3, including its interior.

FIG. 4 shows an end view of the roll-up tube 3 in more detail. Shown are tube projections 43 that project from an interior surface of the roll-up tube 3. Note that the projections as shown form a shape similar to the greek letter "Ω", although other shapes are also supported. The number of projections can vary, with the preferred number of projections being three. However, embodiments using other numbers of tube projections 43 would also be acceptable. It is preferable to have the projections 43 evenly spaced around the interior of the roll-up tube 3. Further, it is preferable that the projections 43 extend some substantial portion into the roll-up tube 3 to accept a motor assembly 20 of various lengths. For ease of manufacture, it is even more preferable that each projection 43 extends the entire longitudinal (or axial) length of the interior of the roll-up tube 3. Slots could be substituted for the projections 43, if preferred.

The roll-up tube 3 is preferably manufactured from a single flat or corrugated sheet of material 41, such as a sheet of steel, aluminum, plastic, or some other material of suitable strength and durability. Alternatively, a number of such sheets can be connected together (such as by some fastening means such as rivets, glue, screws, or some other acceptable fastening means). The sheet(s) are rolled and crimped, stamped, and/or folded, as necessary, during manufacture of the roll-up tube 3 with the tube projections 43 (or slots, if preferred) integrated therein, with perhaps a textured surface for attaching the canopy. Thus, the tube projections 43 (or slots) can be implemented by crimping the sheet of material, for example. Alternatively, the tube projections or slots can be implemented by using fingers or slabs or blocks formed from some material added to the interior of the roll-up tube 3.

Figure 5:
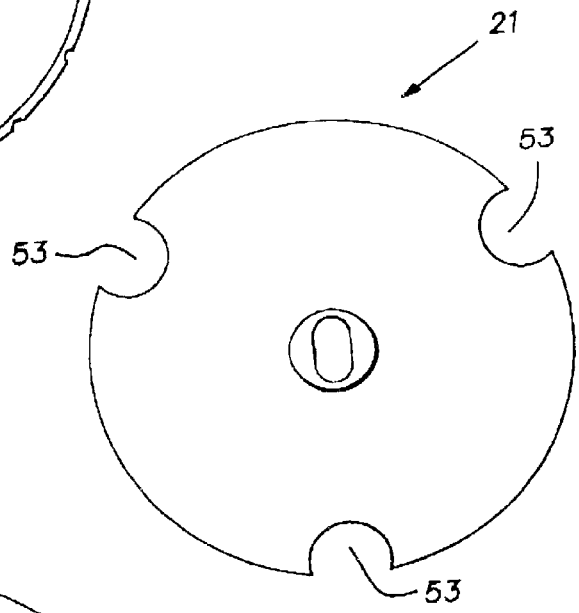
FIG. 5 shows an end view of the transmission linkage 21 with the notches 53 formed thereby.

FIG. 5 shows a close-up of an end view of the transmission linkage 21. Note that in the preferred embodiment, the transmission linkage 21 is a disk formed to include notches 53, which are sized so as to receive the projections 43 of the roll-up tube 3 when the transmission linkage 21, as part of the motor assembly 20, is fully or partially inserted into the roll-up tube 3. The number of notches 53 must be equal to or greater than the number of projections 43, and the notches 53 must be distributed across the circumferential edge of the transmission linkage 21 with spacing corresponding to the spacings between the projections 43 of the roll-up tube 3, so that the notches 53 accept and/or engage the projections 43 upon insertion. Note that because the projections 43 extend some distance into the roll-up tube 3, the motor assembly 20, and thus the transmission linkage 21, can be inserted into the tube at various distances and still ensure that the notches 53 engage the projections 43. Further, the fact that the projections 43 extend some distance into the roll-up tube 3 allows the motor assembly 20, and/or the transmission linkage 21, to move axially (or longitudinally) some distance within the roll-up tube 3 and still allow the notches 53 to engage the projections 43. Alternatives to using the slotted disk for the transmission linkage are also contemplated, such as using one or more finger devices or shafts, for example.

Figure 6:
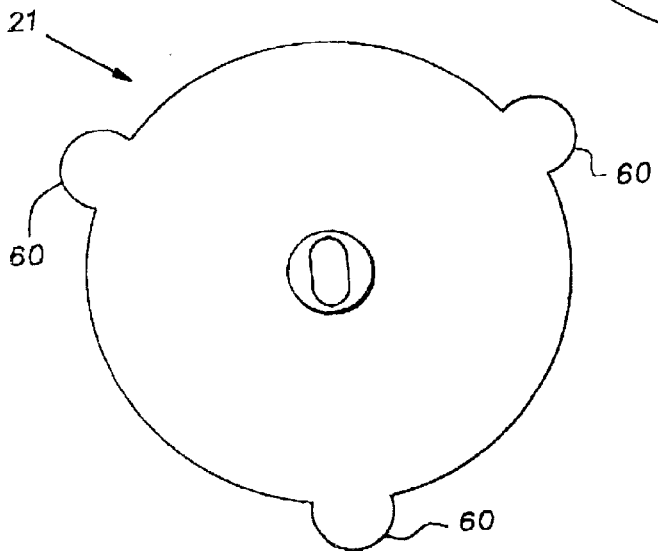
FIG. 6 shows an end view of an alternative transmission linkage 21 with fingers 60 projecting therefrom.

The transmission linkage 21 can be designed to conform to rollup tubes already on the market so that the motor assembly can be retrofitted to awnings already in use or being sold. Further, as an alternative, the transmission linkage could be designed to mate with roll-up tubes with interior slots instead of projections, merely by substituting fingers 60 on the transmission linkage 21 in place of the notches 53, as shown in FIG. 6. The Fingers 60 would then be mated with ridges in the roll-up tube. Examples of other alternative means of connecting the transmission linkage 21 to the roll-up tube 3 include using a gear to mate with a ring gear mounted on the roll-up tube, or using fastening means such as a screw or rivet to connect the transmission linkage to the roll-up tube.

Upon assembly of the awning, the motor assembly 20 is fully, mostly, or at least partially inserted into the roll-up tube 3 sufficient that the transmission linkage 21 engages the projections 43 such that there is only a small amount of play between the transmission linkage 21 and the roll-up tube 3. It is expected that as much of the motor assembly 20 as possible will be inserted into the tube to help protect the motor and for aesthetical reasons. However, it is expected that circumstances may arise whereby some portion of the motor assembly may remain outside of the tube, such as situations where there is some gap between the roll-up tube assembly and a mounting arm.

After proper assembly, upon activation of the motor, the motor shaft, and thus the transmission linkage 21, will rotate only a very small angular amount (the amount being considerably less than 360 degrees divided by the number of projections 43, if the projections 43 are evenly spaced as is preferred) before one or more of the notches 53 contact one or more of the projections 43, providing little play between the projections 43 and the notches 53. Consequently, the rotation of the transmission linkage 21 will quickly cause the roll-up tube 3 to begin rotating, whereby both will rotate at the same rate. By operating the motor in one direction, the awning can thus be made to deploy by causing the roll-up tube to unroll the canopy, whereby the arms will extend the awning and keep the canopy taught. By operating the motor in an opposite direction, the awning can be made to retract by winding the canopy upon the roll-up tube, causing the awning to be pulled toward the support wall, and thus retracting the awning.

The biasing spring is preferably embedded inside the roll-up tube, or alternatively, inside the support arm mounting assembly 9 at one end or on the support end 11 at the other end of the roll-up tube, or alternatively, mounted on one or more ends of the roll-up tube. This spring is installed such that the spring is tensioned upon deployment of the awning, thus biasing the roll-up tube 3 into rotating in a direction such that the awning is at least mostly retracted or fully retracted. By using this spring, the awning can be retracted by releasing the means for releasably connecting 39, 39', allowing the motor to rotate within the roll-up tube and thus allowing the awning to automatically retract using the spring bias. This allows the awning to be at least mostly retracted during conditions wherein the motor cannot be operated. Some final retraction or stowage activity may be further necessary to fully stow the awning and allow a vehicle to be safely operated. In the preferred embodiment, the biasing spring should have sufficiently wound the canopy onto the roll-up tube to greatly simplify the stowage process, leaving only minimal activity, if any, to the individual securing the awning.

As discussed above, the invention can be used to retrofit an existing awning for automating the deployment and retraction of the awning and/or for embedding much of the motor assembly into the roll-up tube. To retrofit an awning, a proper transmission linkage is chosen that is compatible with the awning roll-up tube, and the transmission linkage is inserted into the roll-up tube, with the motor assembly also at least partially inserted into the roll-up tube. The end support disc of the arm mounting assembly is fixably attached to the roll-up tube (such as by using some fastening means known in the art) and the support arm mounting structure of the support arm mounting assembly is connected to a support arm of the awning.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. An awning drive assembly having a roll-up tube, said awning drive assembly comprising a motor assembly, said motor assembly including:

a motor having a motor shaft extending from an end of said motor; and a transmission linkage connected to said motor shaft, said transmission linkage rotationally connecting to the tube when said transmission linkage is inserted into the tube, said transmission linkage rotating when said shaft is rotated when said motor is operated, thereby causing the tube to rotate for deploying or retracting the awning, said transmission linkage forming at least one notch receiving a complementary-shaped projection of the tube for rotationally connecting said transmission linkage to the tube when said motor assembly is at least partially inserted into said tube.

2. The awning drive assembly of claim 1, wherein the roll-up tube has one or more projections along the interior of the roll-up tube, and further wherein said transmission linkage forms at least as many notches as there are projections, such that each projection of the roll-up tube is received by a corresponding notch of said transmission linkage when said motor assembly is at least partially inserted into the tube.

3. The awning drive assembly of claim 1, wherein said transmission linkage is free to move axially inside the roll-up tube when one or more of said motor shaft, said motor, and said motor assembly also moves axially during any of the operation, assembly, and disassembly of said awning.

4. An awning drive assembly having a roll-up tube, said awning drive assembly comprising a motor assembly for at least partially inserting into the tube, said motor assembly including:

a motor having a motor shaft extending from an end of said motor; and a transmission linkage connected to said motor shaft, said transmission linkage connecting to said tube when said transmission linkage is at least partially inserted into the tube, said transmission linkage rotating when said shaft is rotated when said motor is operated, thereby causing the tube to rotate for deploying or retracting the awning; wherein said roll-up tube has one or more projections along the interior of the roll-up tube, wherein said transmission linkage forms at least as many notches as there are projections, such that each projection of the roll-up tube is received by a corresponding notch of said transmission linkage when said motor assembly is at least partially inserted into the roll-up tube, and wherein the little play is provided between the projections and the notches.

5. The awning drive assembly of claim 4, wherein said transmission linkage is free to move longitudinally inside the roll-up tube when one or more of said motor shaft, said motor, and said motor assembly also moves longitudinally during one or more of the operation, assembly, and disassembly of said awning.

6. The awning roller assembly of claim 4, wherein said wherein said one or more projections extend along substantially the entire longitudinal length of the roll-up tube.

7. A The awning roller assembly of claim 6, wherein the total number of said projections is at least three.

8. An awning roller assembly for use in an awning, said awning roller assembly comprising:

a roll-up tube having one or more projections inside said tube; and a motor assembly at least partially inserted into said tube, said motor assembly including:

a motor having a motor shaft extending from an end of said motor; and a transmission linkage connected to said motor shaft, said transmission linkage forming one or more notches, each projection being received by a corresponding notch of said transmission linkage when said transmission linkage is inserted into said tube, said transmission linkage rotating when said shaft is rotated when said motor is operated, thereby causing said tube to rotate for deploying or retracting the awning whenever the transmission linkage is rotating.

9. The awning roller assembly of claim 8, wherein said transmission linkage is not prevented from moving in a longitudinal direction by said tube when said awning roller assembly is fully assembled.

10. The awning roller assembly of claim 9, wherein said roll-up tube has a plurality of projections along the interior of the roll-up tube, and further wherein said transmission linkage forms at least as many notches as there are projections, such that each projection of the roll-up tube is received by a corresponding notch of said transmission linkage when said motor assembly is at least partially inserted into the roll-up tube.

11. The awning roller assembly of claim 10, wherein said projections are evenly distributed across the interior circumferential surface of said roll-up tube.

12. The awning roller assembly of claim 11, wherein said projections extend along substantially the entire longitudinal length of said roll-up tube.

13. The awning roller assembly of claim 8, wherein said roll-up tube has a plurality of projections along the interior of the roll-up tube, and further wherein said transmission linkage forms at least as many notches as there are projections, such that each projection of the roll-up tube is received by a corresponding notch of said transmission linkage when said motor assembly is at least partially inserted into the roll-up tube.

14. The awning roller assembly of claim 8, wherein said roll-up tube and said one or more projections are formed from a single continuous sheet of material formed into a tube, with said projection formed by at least one of folding, crimping, and stamping said sheet of material to form a loop of material projecting toward the central axis of said roll-up tube, thereby forming said projection.

15. The awning roller assembly of claim 8, said awning further comprising a support arm mounting assembly for mounting on a support arm, said support arm mounting assembly fixably connected to said motor assembly; said support arm mounting assembly connected to an end of said roll-up tube.

16. The awning roller assembly of claim 8, wherein said one or more projections extend along substantially the entire longitudinal length of said roll-up tube.

17. An awning comprising:

a roll-up tube having one or more projections inside said tube;

a canopy having one edge connected to said roll-up tube, said canopy being rolled-up on said roll-up tube when said awning is retracted, said canopy also being un-rolled from said roll-up tube when said awning is deployed;

a motor assembly at least partially inserted into said tube, said motor assembly including:

a motor having a motor shaft extending from a first end of said motor, said motor shaft rotating when said motor is operated for deploying or retracting said canopy; and a transmission linkage fixably connected to said motor shaft, said transmission linkage forming one or more notches, each having a complementary shape for receiving a different one of said projections when said motor assembly is at least partially inserted into said tube, said transmission linkage rotating when said motor shaft is rotating, thereby causing said tube to rotate;

and a support arm mounting assembly for mounting on a support arm, said support arm mounting assembly releasably connected to said motor assembly;

said mounting assembly movably connected to an end of said tube;

wherein, if said motor is operated to rotate in one direction, said awning is deployed, and further wherein, if said motor is operated to rotate in an opposite direction, said awning is retracted.

18. The awning of claim 17, wherein said roll-up tube has a plurality of projections, and further wherein said transmission linkage forms at least as many notches as there are projections, such that each projection of said tube is received by a corresponding notch of said transmission linkage when said motor assembly is at least partially inserted into said roll-up tube.

19. The awning of claim 18, wherein said plurality of projections includes at least 3 projections.

20. The awning of claim 19, wherein said plurality of projections consists of exactly 3 projections.

21. The awning of claim 17, wherein said projections are evenly distributed across the interior circumferential surface of said roll-up tube, and further wherein the number of notches of said transmission linkage are equal to the number of projections.

22. The awning of claim 21, wherein said projections extend to substantially the entire longitudinal length of said roll-up tube.

23. The awning of claim 17, wherein said one or more projections extend along substantially the entire longitudinal length of said roll-up tube.

24. The awning of claim 17, said motor assembly further including a motor sleeve for mostly surrounding said motor when said motor is inserted into said motor sleeve.

25. The awning of claim 24, said motor assembly further including a sleeve cap fixably connected to said motor sleeve, said sleeve cap for holding said motor within said motor sleeve, said sleeve cap also for releasably connecting to said support arm mounting assembly, wherein said motor cannot rotate within said motor sleeve but said motor shaft can rotate when said sleeve cap is connected to said support arm mounting assembly.

26. The awning of claim 24, wherein said motor assembly can freely rotate along with said roll-up tube when said sleeve cap is released from said support arm mounting assembly.

27. The awning of claim 25, said sleeve cap having a sleeve cap projection and said support arm mounting assembly including an end support cap movably connected to said sleeve cap projection, wherein said roll-up tube is fixably connected to said end support cap, allowing said roll-up tube to rotate along with said end support cap.

28. The awning of claim 27, said support arm assembly further including:

a support arm mounting structure for fixably connecting to an end of said support arm; and means for releasably connecting, wherein said sleeve cap projection is releasably connected to said support arm mounting structure by said means for releasably connecting, wherein, when said means for releasably connecting is connected, said motor assembly is prevented from rotating within said tube when said motor shaft is rotating said roll-up tube.

29. An awning comprising:

a roll-up tube having a plurality of projections inside said tube projecting from the interior of said tube;

a canopy having one edge connected to said roll-up tube, said canopy being rolled-up on said roll-up tube when said awning is retracted, said canopy further being un-rolled from said roll-up tube when said awning is deployed;

a motor assembly at least partially inserted into said tube, said motor assembly including:

a motor having a motor shaft extending from a first end of said motor, said motor shaft rotating when said motor is operated for deploying or retracting said canopy;

a transmission linkage fixably connected to said motor shaft, said transmission linkage forming a plurality of notches corresponding to said plurality of projections of said tube, each of said plurality of notches for receiving one of said plurality of projections when said motor assembly is at least partially inserted into said tube providing little play between each protection and each corresponding notch, said transmission linkage rotating when said motor shaft is rotating, thereby causing said plurality of notches to engage said plurality of projections thereby causing said tube to rotate;

a motor sleeve for mostly covering said motor when said motor is inserted into said motor sleeve; and a sleeve cap fixably connected to said motor sleeve, said sleeve cap for holding said motor within said motor sleeve, said sleeve cap having a sleeve cap projection projecting from one end;

a support arm mounting assembly for mounting on a support arm, said support arm mounting assembly including:

an end support cap movably connected to said sleeve cap projection, wherein said roll-up tube is fixably connected to said end support cap, allowing said roll-up tube to rotate along with said end support cap;

a support arm mounting structure for fixably connecting to an end of said support arm; and means for releasably connecting said sleeve cap projection to said support arm mounting structure, wherein said motor within said motor assembly is prevented from rotating within said tube by said means for releasably connecting when said motor shaft is rotating said tube; and wherein, if said motor is operated to rotate in one direction, said awning is deployed, and further wherein, if said motor is operated to rotate in the opposite direction, said awning is retracted.

30. An awning roller assembly for use in an awning, said awning roller assembly comprising:

a roll-up tube having at least three projections inside said tube, said projections projecting from the interior of said tube toward a center axis of said tube, said projections being evenly distributed across an interior circumference of said tube, said projections extending along substantially the entire longitudinal length of said tube;

a motor assembly at least partially inserted into said tube, said motor assembly including:

a motor having a motor shaft extending from a first end of said motor, said motor shaft rotating when said motor is operated for deploying or retracting said canopy; and a transmission linkage fixably connected to said motor shaft, said transmission linkage forming at least three notches corresponding to said at least three projections of said tube, each of said at least three notches for receiving one of said at least three projections when said motor assembly is at least partially inserted into said tube, said transmission linkage rotating when said motor shaft is rotating, causing said at least three notches to engage said at least three projections, thereby causing said tube to rotate whenever the transmission linkage is rotating;

and a support arm mounting assembly for mounting on a support arm, said support arm mounting assembly connected to an end of said motor assembly; said mounting assembly movably connected to an end of said tube.

31. A method of installing an awning drive assembly in an awning, said awning including a roll-up tube having one more or more projections, said method comprising the steps of:

obtaining said awning; and inserting a motor assembly at least partially into an end of the tube, said motor assembly including:

a motor having a motor shaft extending from an end of said motor; and a transmission linkage connected to said motor shaft, said transmission linkage forming one or more notches, wherein each of the projections is received by one of the notches when said transmission linkage is inserted into said tube, said transmission linkage rotating when said shaft is rotated when said motor is operated, thereby causing said tube to rotate whenever the shaft is rotating for deploying or retracting the awning.

32. The method of claim 31, further including the steps of:

connecting a support arm mounting assembly to a support arm of the awning, said support arm mounting assembly connected to said motor assembly;

said support arm mounting assembly having an end cap moveably connected to said support arm mounting assembly, said support arm mounting assembly connected to said motor assembly; and fixably connecting said end to the end of said roll-up tube.

* * * * *